US006272785B1

(12) United States Patent
Mika et al.

(10) Patent No.: US 6,272,785 B1
(45) Date of Patent: Aug. 14, 2001

(54) GUN HOLDER

(76) Inventors: Jerry M. Mika, 12187 S. 2840 W., Riverton, UT (US) 84065; Jerry B. Reynolds, 7187 W. 13700 S., Herriman, UT (US) 84065

( * ) Notice: Subject to any disclaimer, the term of this patent is extended or adjusted under 35 U.S.C. 154(b) by 0 days.

(21) Appl. No.: 09/349,876

(22) Filed: Jul. 8, 1999

(51) Int. Cl.[7] ..... F41C 27/00

(52) U.S. Cl. ..... 42/94; 89/37.01; 89/37.04; 89/40.1

(58) Field of Search ..... 42/94; 89/40.1, 89/40.2, 40.3, 40.4, 40.5, 40.6, 37.04, 37.01

(56) References Cited

U.S. PATENT DOCUMENTS

| | | | | |
|---|---|---|---|---|
| 1,367,353 | * | 2/1921 | Craig | 42/94 |
| 2,870,633 | | 1/1959 | Wilson | 89/40 |
| 3,703,046 | | 11/1972 | Barone et al. | 42/94 |
| 4,017,997 | * | 4/1977 | Peterson et al. | 42/94 |
| 4,265,045 | | 5/1981 | Garbini | 42/94 |
| 4,266,748 | | 5/1981 | Dalton | 248/425 |
| 4,535,559 | * | 8/1985 | Hall | 42/94 |
| 4,790,096 | * | 12/1988 | Gibson et al. | 42/94 |
| 4,841,839 | * | 6/1989 | Stuart | 89/37.04 |
| 4,903,425 | | 2/1990 | Harris | 42/94 |
| 4,967,497 | | 11/1990 | Yakscoe | 42/94 |
| 5,067,268 | | 11/1991 | Ransom | 42/94 |
| 5,194,678 | * | 3/1993 | Kramer | 42/94 |
| 5,347,740 | | 9/1994 | Rather et al. | 42/94 |
| 5,421,115 | | 6/1995 | McKay | 42/94 |
| 5,491,919 | * | 2/1996 | Rather et al. | 42/94 |
| 5,596,830 | | 1/1997 | Morgan | 42/94 |
| 5,685,104 | | 11/1997 | Breazeale, Jr. | 42/94 |
| 5,697,181 | | 12/1997 | Savant | 42/94 |
| 5,711,103 | | 1/1998 | Keng | 42/94 |
| 5,758,447 | | 6/1998 | Venetz | 42/94 |
| 5,778,589 | | 7/1998 | Teague | 42/94 |
| 5,808,227 | | 9/1998 | Amos | 89/36.01 |
| 5,811,720 | | 9/1998 | Quinnell et al. | 89/37.04 |
| 5,815,974 | | 10/1998 | Keng | 42/94 |
| 5,875,580 | | 3/1999 | Hill et al. | 42/94 |
| 6,044,747 | * | 4/2000 | Felts | 89/40.06 |

* cited by examiner

*Primary Examiner*—Charles T. Jordan
*Assistant Examiner*—J. A. Richardson
(74) *Attorney, Agent, or Firm*—Workman, Nydegger & Seeley

(57) ABSTRACT

Gun support devices and assemblies for securing a gun, such as a rifle or a shotgun, in a fixed position relative to the ground. The gun support device has an elongate channel defined by a central portion and left and right sidewalls extending laterally from the central portion. The elongate channel is shaped to receive at least a portion of a region of a gun that extends between the forearm and the trigger of the gun. The central portion generally supports the gun, while the left and the right sidewalls generally restrain longitudinal motion of the gun with respect to the gun support device. An opening extends through the central portion at a position to permit at least a portion of the trigger of the gun to extend therethrough, thereby making the trigger accessible while the gun is received in the elongate channel. The gun support device further has an attachment mechanism for attaching the gun support device to a tripod or another support structure. Placing a gun in the gun support devices relieves the gun user of the task of holding the gun for extended periods of time and from resting the gun on the ground.

24 Claims, 4 Drawing Sheets

GUN HOLDER

BACKGROUND OF THE INVENTION

1. Field of the Invention

The present invention relates to firearm accessories. In particular, the present invention relates to gun support devices for holding a rifle or a shotgun in a desired position.

2. Relevant Technology

For safety reasons, any hunter, target shooter, or other kind of gun user must be constantly aware of where his gun is being pointed. This is true not only as the gun is being fired, but also when the gun is not currently being used. Being aware of where a gun is pointed is the first tenet of firearm safety. For example, when a person is hunting with a rifle or shotgun, the hunter must always carefully point the gun away from other people and in a direction where no damage will be done if the gun accidentally fires.

Oftentimes, hunters sit or stand for extended periods of time in a single location. When doing so, hunters have had several choices of how they maintain their guns pointed in a safe direction. Perhaps the most frequently used technique involves the hunter holding the gun in a steady position and in a safe direction while ensuring that nobody walks in front of the gun. This technique can almost entirely ensure safety if the gun user is vigilant. However, holding a gun for extended periods of time is inconvenient because it can lead to fatigue or can prevent the gun user from participating in other activities that require the use of the hands.

Alternatively, in order to free up the hands, many gun users resort to placing their guns on the ground or propping them against a tree or another makeshift support. This approach to gun handling has several drawbacks. First, when a gun is placed on the ground or propped against an object, it is often not secured against accidental movement. For example, placing a gun against a tree often involves a balancing act that can result in the gun toppling if bumped or, sometimes, for no apparent reason at all. When a gun is displaced from a temporary resting position, it could discharge or at least be damaged. Accordingly, resting a shotgun or a rifle on the ground or an object in the gun's surroundings is often an unwise practice. However, because acceptable alternatives have not always been available, many hunters have done so.

Placing a gun on an object or on the ground is also often undesirable because the gun may be scratched or otherwise damaged even if no accidental gun movement. Many gun owners have had their guns damaged in this way. In some situations, hunters may be unable to lay their guns down on the ground or on a nearby object. For example, many waterfowl hunters hunt from blinds positioned in or near a body of water where no nearby dry ground is available. Furthermore, if a gun falls from a hunter's arm or from a temporary resting spot into the water, the gun may be severely damaged.

Many gun owners have experienced similar problems upon resting a gun against a makeshift support to brace the gun while firing. Many hunters can improve their aim by placing the stock or barrel of the gun against a tree branch or another similar object. Bracing the gun in this manner eliminates much of the unsteadiness of the shooter's hands. Bracing guns is also practiced while calibrating an optical or mechanical sight on the gun. For example, many target shooters rest their guns against stationary objects, such as truck tailgates, benches, and the like, at shooting ranges.

Bracing a gun against a tree branch, a truck tailgate, or another convenient object has several drawbacks. First, movement of the gun against the hard surface while the gun is fired can easily mar the finish of the gun. In addition, bracing a gun against an object as described above is often awkward, and does not always eliminate unsteadiness while shooting.

In view of the foregoing, it could be an advancement in the art to provide devices or structures for securely resting a gun in a safe position without the gun having to be held by the gun user. It would be particularly useful if the structure or device could be used in the field in a variety of environmental conditions. It would be advantageous to provide such a support device or structure that can also securely brace the gun while firing, whether at the shooting range or in the field.

SUMMARY AND OBJECTS OF THE INVENTION

The present invention relates to structures and devices securely supporting a gun. The gun support devices of the invention include a body defining an elongate channel shaped to receive a portion of a region of a gun that extends between the trigger and the forearm of the gun. The gun support devices can be mounted on a tripod or another support structure so that the gun held therein can be securely positioned with respect to the ground. The gun support devices of the invention can have several uses, including providing a safe technique for supporting guns in the field or at the shooting range and enabling guns to be securely braced while being fired.

In one implementation, the gun support devices of the invention include a generally flat center portion flanked by two restraining sidewalls. Together, the central portion and the restraining sidewall define an elongate channel or recess dimensioned to receive a gun, such as a rifle or a shotgun. The central portion generally supports the majority of the weight of the gun, while the two lateral sidewalls generally restrain the gun from lateral motion.

The central portion of the gun support device has an opening formed therethrough that admits the trigger assembly of the gun when the gun is received in the elongate channel. At least a portion of the trigger can thereby extend through the gun support device and beyond the lower surface of the gun support device. The trigger assembly is accessible by the gun user when the gun is received in the gun support device.

The gun support devices of the invention can be formed in part by a pliable material that contacts the gun when the gun is received in the gun support device. The pliable material protects the finish of the gun from damage. Any of a large number of soft or pliable materials can be used, including polyurethane, other foamed or pliable polymeric materials, natural or synthetic fur, natural or synthetic fabrics, and the like. The gun support device can also be partially formed by a rigid material or can instead be entirely formed by the soft or pliable material. For instance, aluminum or other metals can be used to provide rigidity to the central portion and lateral sidewall.

The gun support devices can further include one or more straps for tightly holding a gun within the elongate channel For example, when a gun is received in the gun support device, a strap can extend from one lateral sidewall to the other. The strap can be removably secured to one lateral sidewall by means of Velcro, snaps, buckles or the like. The elongate channel can have a longitudinal axis that is generally parallel to the longitudinal axis of the barrel of the gun.

The gun support devices can be attached to a tripod or other supporting structure using an attachment mechanism formed on the lower surface of the central portion. For example, the lower portion may have formed therein one or more threaded sockets that removably mate with a screw on the mounting structure of a tripod. Including multiple threaded sockets along the midline of the body of the gun support devices allows the point of attachment to be positioned near the center of gravity of the gun.

When a gun user takes a gun to the field or the shooting range, the gun support device in combination with a tripod or another supporting structure can conveniently support the gun when not in use and, optionally, while in use. No longer does the hunter need to hold a rifle or shotgun for extended periods of time or temporarily rest a gun against a tree or another object. Instead, the gun support devices disclosed herein provide a safe and secure resting place for guns. The gun user's hands are free to engage in other activities, the gun can be continually pointed in a safe direction, and the gun damage can be prevented by use of the gun support devices. Similarly, the gun support devices can provide a stable support for guns as they are being fired. Gun users can thereby avoid resorting to bracing guns against trees, truck tailgates, or other generally unsuitable objects.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims. These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The present invention relates to devices for supporting a gun, such as a sport rifle or a sport shotgun. The gun support devices of the invention include a body having an elongate channel for receiving at least a portion of a region of a gun that extends between the trigger and the forearm of the gun. The body has a central portion substantially defining the bottom of the elongate channel. The body further has left and right sidewalls laterally disposed from the central portion and substantially defining the left and right surfaces of the elongate channel, respectively. The body includes an attachment mechanism, such as a threaded socket, that can be removably attached to a tripod or another support structure.

When a hunter, a target shooter, or another gun user wishes to rest a gun in a safe and secure position, the gun user places the gun in the elongate channel of the gun support device. The gun can thereby be pointed in a safe direction while the gun is not in use. When the gun user desires to shoot the gun, the gun can be removed from the gun support device or can be fired while resting in the gun support device. For instance, a hunter might remove the gun from the gun support device before using the gun or might instead decide to fire the gun while it rests in the gun support device. A target shooter can use the gun support device as a steady brace while shooting to test the accuracy of the gun or to calibrate a scope.

Figure 1:
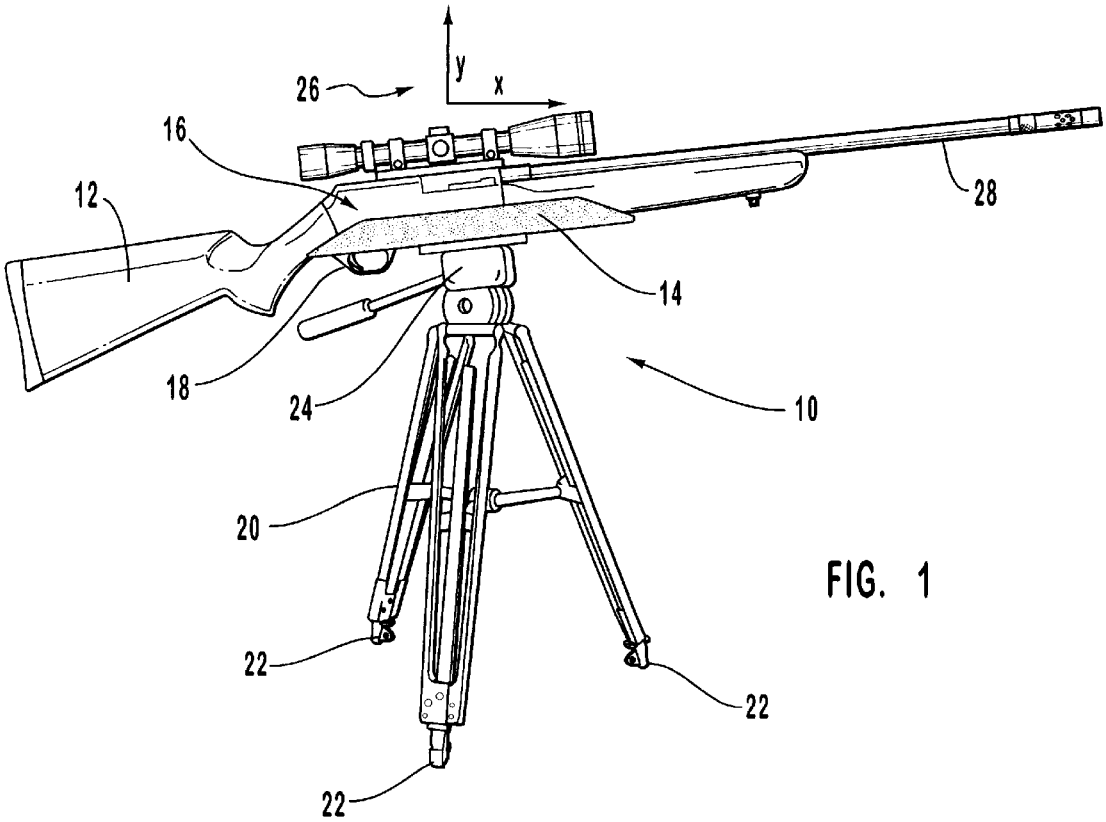
FIG. 1 is a perspective view of an embodiment of the gun support devices of the invention, wherein the gun support device is included in a gun support assembly.

FIG. 1 illustrates an embodiment of the gun support devices being used as part of a gun support assembly 10. Gun 12, which can be a rifle, as shown, or a shotgun, rests on support device 14. In particular, gun support device 14 removably receives at least a portion of a region of the gun that extends between the trigger 18 and the forearm 16 of gun 12, and securely supports the gun with respect to the ground. Gun support device 14 can also receive other portions of the gun. For instance, a portion of stock 17 and a portion of forearm 16 are positioned in gun support device 14 of FIG. 1. Trigger mechanism 18 of gun 12 extends through an opening formed in the body of gun support device 14, thereby exposing the trigger to the gun user while the gun is supported.

The gun support assembly illustrated in FIG. 1 further includes a tripod 20, which is one example of the support structures that can be used with the invention. Tripod 20 can be a conventional tripod traditionally used in photography. Those skilled in the art, upon learning of the disclosure made herein, will recognize that other support structures can be removably attached to gun support device 14. For instance, tripod 20 can be replaced with a column fixed to the ground when gun support device is used at a shooting range. Alternatively, tripod 20 can be replaced with another support structure having one or more legs.

Tripod 20 exhibits certain features that allow it to be advantageously used in the gun support assemblies of the invention. For example, tripod 20 has three legs 22, each of which is independently adjustable to a desired length. Thus, when tripod 20 is used by hunters in the field or by target shooters at a shooting range, legs 22 can be individually adjusted to correspond to possibly uneven terrain. Accordingly, tripod 20 can be used to hold gun support device 14 and gun 12 at a desired orientation in a variety of surroundings.

As shown in FIG. 1, tripod 20 includes a rotatable joint 24 allowing gun support device 14 and gun 12 to be rotated about at least one axis and as many as two axes with respect to the ground. The invention can be practiced using tripods that allow the gun support devices and guns to have zero, one, or two degrees of rotational freedom, regardless of the axes of rotation. FIG. 1 illustrates one example of a tripod having two degrees of rotational freedom. Coordinate reference frame 26 of FIG. 1 is but one example of the reference frames that can be used to describe the possible movement of rotatable joint 24, and is presented for illustration purposes only and should not be construed to limit the tripods that can be used with the invention.

The x axis of reference frame 26 is defined herein to be substantially horizontal with respect to the ground and extending generally in the horizontal direction defined by the longitudinal axis of barrel 28 of gun 12. The y axis of reference frame 26 is defined herein to be substantially vertical with respect to the ground. Similarly, the z axis, which extends upwards out of the page of FIG. 1, is defined to be generally horizontal and orthogonal with respect to the x and y axes. As gun 12 rests on gun support device 14, rotatable joint 24 can be used to rotate gun 12 about the y axis and/or about the z axis.

Although not presently preferred, tripods allowing a third degree of rotational freedom (i.e., rotation about the x axis) can also be used with the invention. It is noted, however, that rotation about the x axis is essentially equivalent to rotating gun 12 about the longitudinal axis of barrel 28, which is generally avoided by shooters.

Gun support assembly 10 can be used in at least two general ways. First, gun assembly 10 can be used to temporarily support gun 12 while the gun is not in use. In this case, the gun user will typically point barrel 28 in a safe direction. Barrel 28 can be pointed in the desired, safe direction by orienting tripod 20 such that the barrel is pointing in the selected direction without any further adjustment of joint 24. Alternatively, the gun user can set up tripod 20 at an arbitrary orientation, while later adjusting joint 24 to point barrel 28 in the selected direction. Sometimes, the gun user will need to reorient gun 12 in response to conditions in the surroundings, when, for example, another person is about to move into the line of sight of barrel 28. The reorientation can be easily performed by rotating gun support device 14 using joint 24. Second, gun assembly 10 can be used as a brace when firing gun 12. In this case, the gun user can arbitrarily set up tripod 20, while later adjusting joint 24 to point barrel 28 at the desired target.

Figure 2:
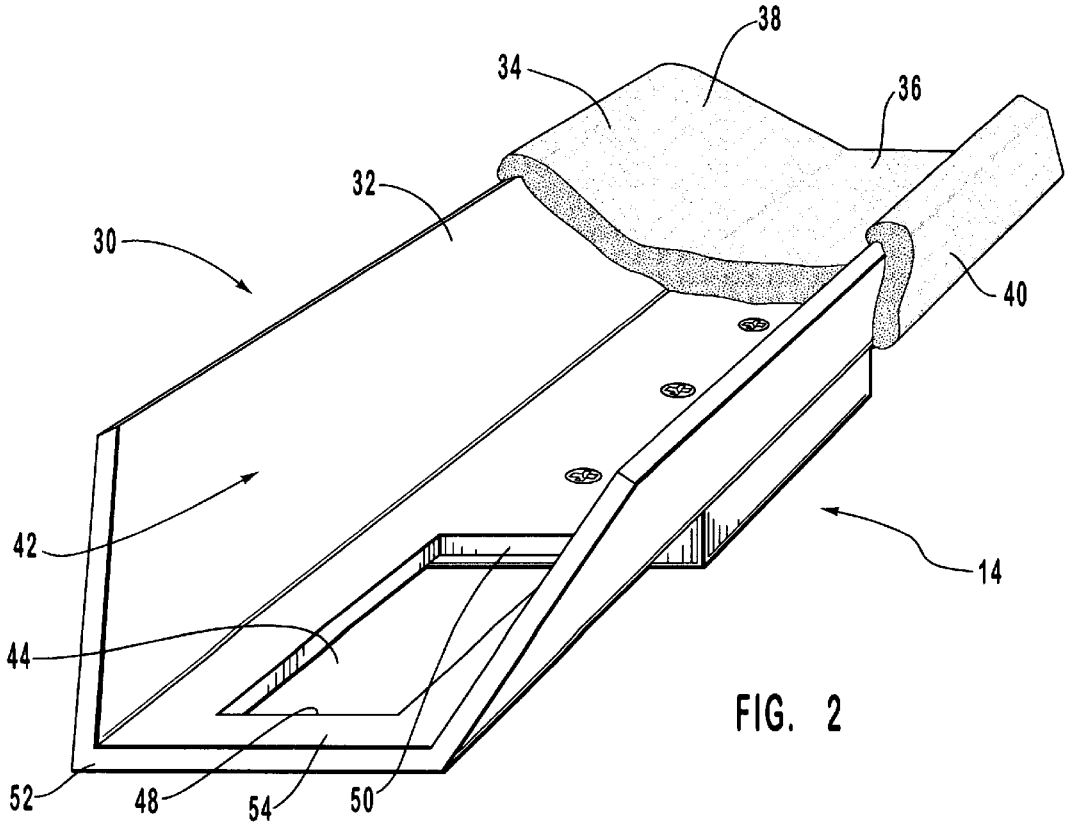
FIG. 2 is a perspective view of the gun support device of FIG. 1, showing a rigid substrate supporting a pliable portion.

FIG. 2 illustrates the body 30 of gun support device 14 in greater detail. Gun support device 14 can be broadly described as a structure that can hold a gun and that is attachable or detachable to a conventional tripod. Of course, the invention also extends to gun support devices that are attachable to other tripods or other support structures. As used herein, the term "hold" a gun includes the act of receiving, supporting, or securing a gun such that it does not fall or drop to the ground or the act of maintaining a gun in a desired position with respect to the gun support device.

In this embodiment, body 30 includes a rigid substrate 32 and a pliable portion 34 (shown in breakaway view) formed over or supported by the rigid substrate. Alternatively, in other embodiments, the body of the gun support device can be a unitary construction. Rigid substrate 32 can be formed from aluminum, other metals, thermoplastics, thermosetting plastics, or other suitable materials. It has been found that aluminum is a preferred material due to its cost and favorable weight and fabrication properties.

Pliable portion 34 can be formed from any of a number of materials, including polymeric foams, natural or synthetic fabrics, carpet, natural or synthetic fur, or any other suitable material. Pliable portion 34 preferably is sufficiently pliable so as to mold to or grip the surface of the gun received in body 30, while not marring or otherwise damaging the finish of the gun. It has been found that polyurethane is a particularly advantageous material from which pliable portion 34 can be formed. When body 30 has the two-part construction illustrated in FIG. 2, pliable portion 34 instead of rigid substrate 32 preferably contacts the gun. Thus, pliable portion 34 represents one example of cushioning means for gripping the gun when the gun is removably secured in gun support device 14.

Body 30 includes a central portion 36 that provides a base against which the gun can rest when it is disposed on body 30. A left sidewall 38 and a right sidewall 40 each extends laterally from central portion 36. Left sidewall 38 and right sidewall 40 substantially restrain the gun from experiencing lateral motion when the gun is disposed on body 30. Together, central portion 36, left sidewall 38, and right sidewall 40 define an elongate channel 42 or recess that is shaped to receive at least a portion of the region of the gun that extends between the trigger and the forearm. Accordingly, elongate channel 42 represents one example of means for receiving at least a portion of the region of a gun that extends between the trigger and the forearm.

Elongate channel 42 is shaped to support the gun that is placed therein, while restraining lateral motion of the gun. In particular, the surfaces of central portion 36, left sidewall 38, and right sidewall 40 can be shaped to conform to the surfaces of the gun that is to be received by elongate channel 42. The precise shape of elongate channel 42 is selected based on considerations that include tradeoffs between providing a tight fit for a particular gun and enabling gun support device 14 to be used with a variety of guns. For example, if it is known that gun support device 14 is to be used with only one gun, elongate channel 42 can be precisely shaped to correspond to the dimensions of the particular gun. On the other hand, if gun support device 14 is to be used with many different guns, elongate channel 42 can be given a shape that roughly corresponds to the dimensions of typical rifles, shotguns, or both.

As shown in FIG. 2, body 30 has an opening 44 formed therethrough. As discussed above in reference to FIG. 1, opening 44 is positioned and sized to enable a trigger mechanism of the gun to pass therethrough. Accordingly, opening 44 represents one example of means for enabling a user of the gun to access the trigger while the gun is received in gun support device 14. Opening 44 also performs a second function by restraining longitudinal motion of the gun. For instance, as can be envisioned in FIGS. 2 and 3, if gun support device 14 is tilted to point the gun above the horizontal plane, the gun can move longitudinally only until the trigger guard 46 abuts surface 48. Likewise, if gun support device 14 is tilted to point the gun below the horizontal plane, trigger guard 46 cannot move beyond surface 50.

The presently preferred configuration of opening 44 is a hole passing through central portion 36 of body 30, one example of which is illustrated in FIG. 2. However, the invention can also be practiced with a different opening 44. For instance, opening 44 can take the form of a slot formed into central portion 36 from proximal end 52. Proximal end 52 is defined as the end nearest the stock of the gun when the gun is received in the elongate channel. When opening 44 is a slot, surface 48 and the adjacent portion (shown generally at 53) of central portion 36 are not present. Although gun support device 14 would have diminished capacity to restrain longitudinal motion of the gun when a slot is used as opening 44, this alternative embodiment is included within the scope of the invention. Thus, a slot represents another example of means for enabling a user of the gun to access the trigger.

Figure 3:
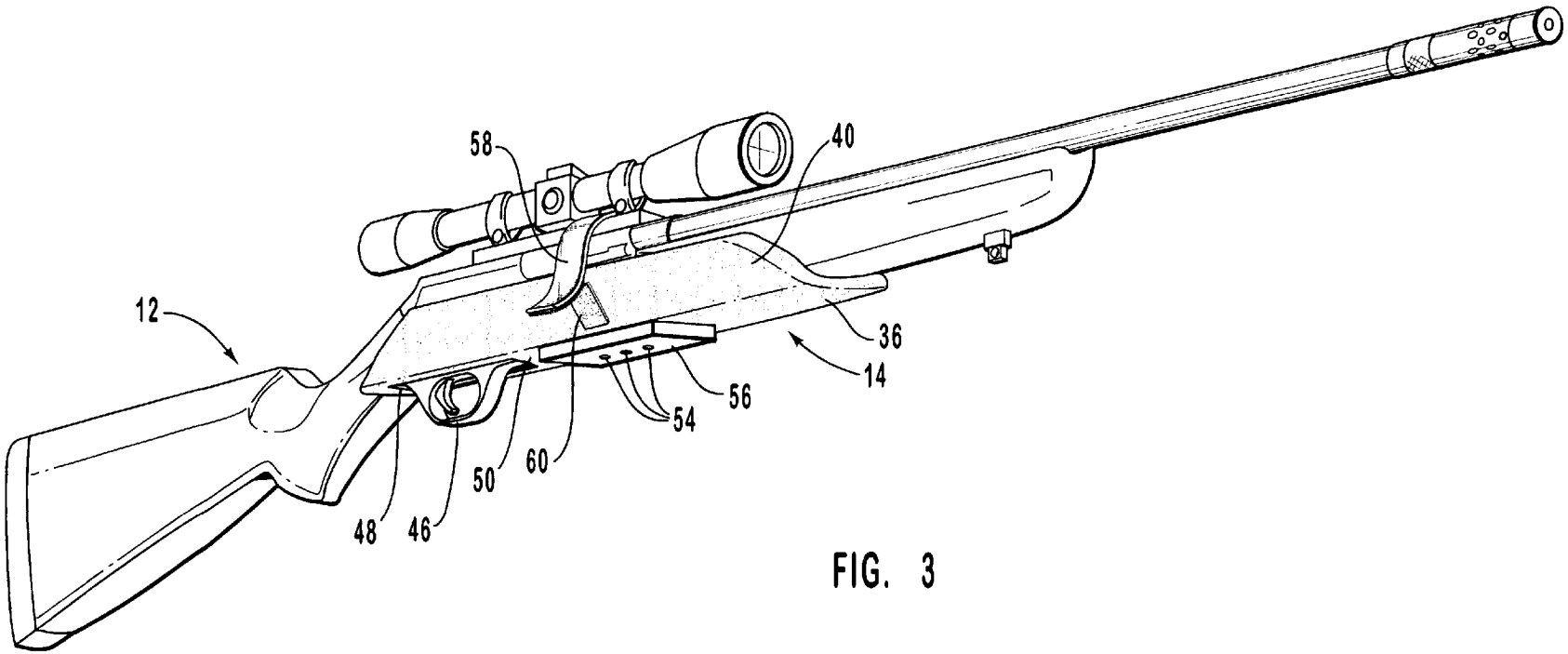
FIG. 3 is a perspective view of the gun support device of FIG. 2, with a gun being received in the elongate chamber of the gun support device.

Referring again to FIG. 3, one example of an attachment mechanism for removably attaching gun support device 14 to the tripod is illustrated. The attachment mechanism in this embodiment includes one or more threaded sockets 54 positioned generally along the longitudinal midline of gun support device 14. In the embodiment of FIG. 3, threaded sockets 54 are formed in a mounting plate 56 attached to central portion 36. Alternatively, threaded sockets 54 can be formed directly in central portion 36. When more than one threaded socket 54 is included in gun support device 14, any of the threaded sockets can be selected to connect the gun support device to the tripod or the other support structure. Including more than one threaded socket 54 enables the user to balance the gun support device and gun over the tripod. In particular, the threaded socket 56 nearest the center of gravity of the assembly that includes gun support device 14 and gun 12 can be selected. Nonetheless, the invention can be practiced using a single threaded socket 54. When gun support device 14 is to be used in combination with a tripod, threaded sockets 54 can be standard sockets that mate with standard threaded pins that are known in the art and conventionally used on tripods. Thus, threaded sockets 54 represent one example of means for attaching sun support device 14 to a tripod or another support structure.

To further secure gun 12 in position within gun support device 14, at least one strap can be tightened over the gun. Strap 58 can be removably attached to right sidewall 40 (or left sidewall 38) by means of a Velcro pad 60 when the strap is tightened over gun 12. Alternatively, Velcro pad 60 can be replaced with a snap, buckle, or any other suitable device for conveniently attaching and releasing strap 58 to right sidewall 40 (or left sidewall 38). As shown in FIG. 3, strap 58, when tightened over gun 12, further restrains lateral, longitudinal, and vertical motion of the gun. While strap 58 can be advantageously used for the foregoing purposes, it is not necessary for the invention to be successfully implemented.

Figure 4:
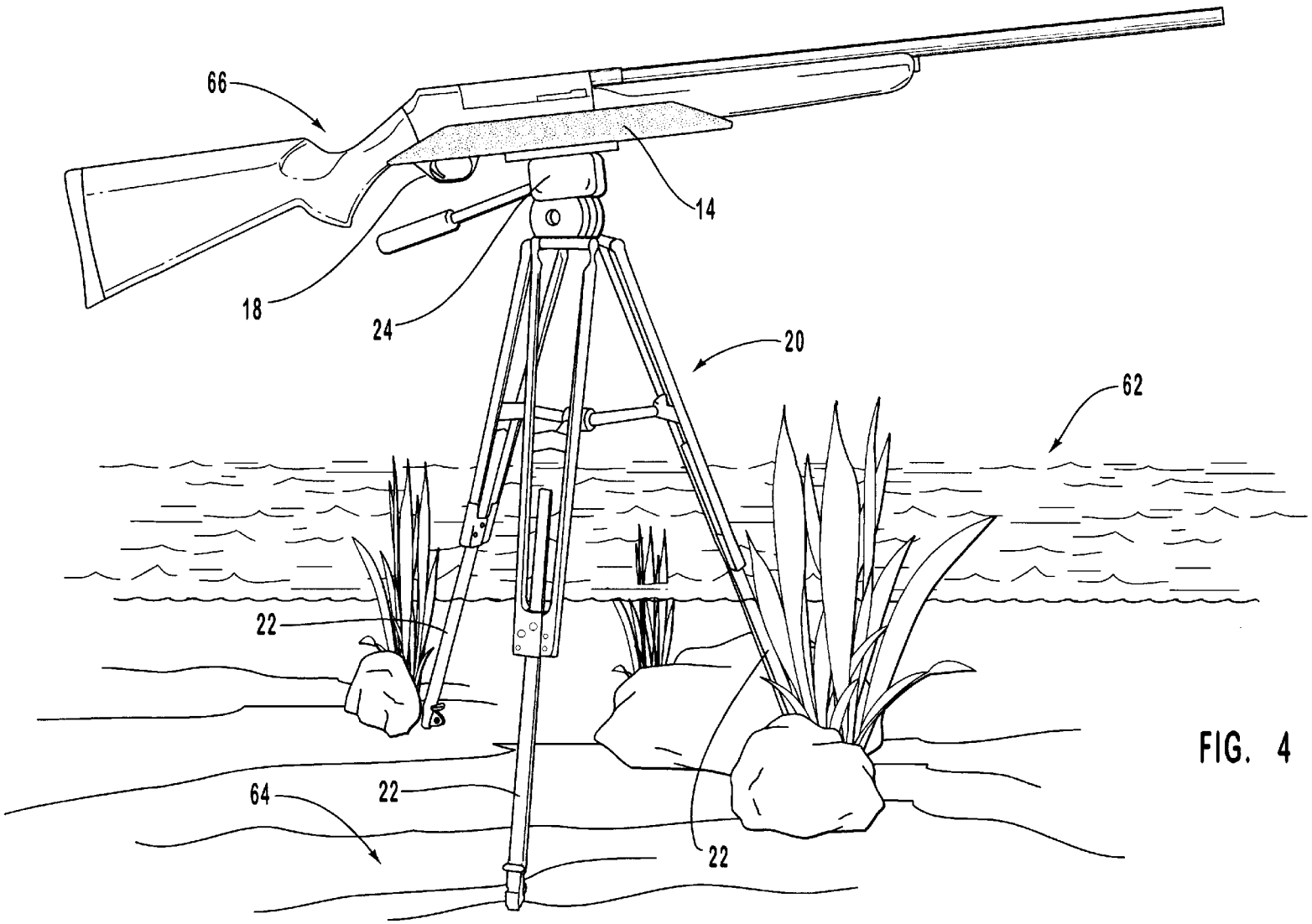
FIG. 4 illustrates the gun support assembly of FIG. 1 being used in a body of water.

Using the gun support devices and the gun support assemblies disclosed herein, gun users can conveniently support their guns while they are not in use or while they are being fired. Placing a gun on the gun support devices of the invention can allow hunters to avoid holding the gun for extended periods, as might otherwise be necessary. The gun support devices further prevent guns from being placed on the ground, against a tree, or on another object that may result in damage to the gun or unsafe gun placement. FIG. 4 illustrates a gun support device and an associated gun support assembly being used in a way that is particularly attractive to waterfowl hunters. The conventional problems associated with gun placement have been particularly pronounced for waterfowl hunters who may wait for long periods of time in blinds situated in or near a body of water. Tripod 20 has been erected in a body of water 62, with legs 22 resting on bed 64. Shotgun 66 is placed on gun support device 14, thereby freeing the waterfowl hunter's hands from the tiring task of holding the shotgun while waiting for shooting opportunities. FIG. 4 illustrates one example of the wide variety of environments in which the gun support devices and gun support assemblies of the invention can be used.

Figure 5:
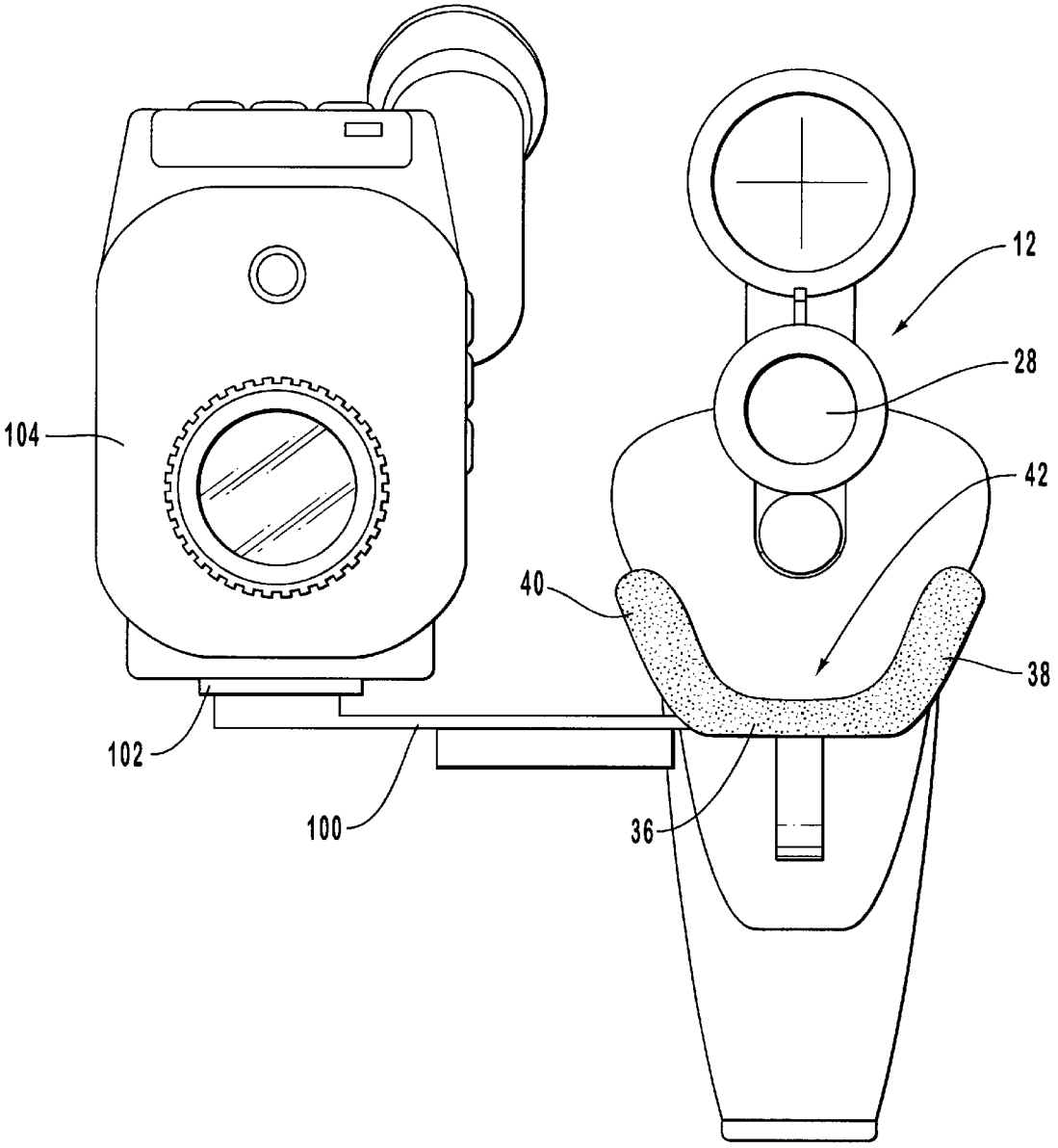
FIG. 5 illustrates an alternative embodiment of the gun support devices of the invention, in which a gun and optical equipment, such as a video camera, are removably attached to the gun support device.

FIG. 5 illustrates a second embodiment of the gun support devices of the invention, in which an optical device, in addition to the gun, is mounted on the gun support device. Gun support device 114 includes central portion 36, a left sidewall 38, and a right sidewall 40 defining an elongate channel 42, similar to the corresponding structures of gun support device 14 of FIGS. 1–4. Gun 12 is received in elongate channel 42 as described above in reference to FIGS. 1–4. In this embodiment, gun support device 114 includes an arm 100 and a mounting plate 102 for removably attaching a video camera 104. Alternatively, mounting plate 102 may be used to removably attach other optical equipment, including a photographic camera or a scope, such as those commonly mounted on rifles. Mounting plate 102 can include a standard threaded pin that mates with the threaded sockets conventionally formed in the base of video cameras or photographic cameras. Similarly, gun support device 114 includes threaded sockets (not shown) formed within a mounting plate 156 or directly within gun support device 114, thereby enabling the support device to be connected to a tripod or another support structure.

Including a optical equipment, such as video camera 104, a photographic camera, or a scope, can allow the gun user to operate the gun in new and interesting ways. For example, the line of sight of video camera 104 can be aligned with the line of sight of barrel 28. Video camera 104 can therefore be used to record footage downrange of gun 12 as the gun is fired. Hunting movies can be produced using the embodiment of FIG. 5 without requiring a separate person to film the action. In particular, if gun 12 is fired while positioned within elongate channel 42, the shooter, himself, is capable of simultaneously operating video camera 104.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for supporting a gun, comprising:

a body defining an elongate channel shaped to receive at least a portion of a region of a gun that extends between a trigger and a forearm of the gun, the body including a central portion, a left sidewall laterally disposed from the central portion, and a right sidewall laterally disposed from the central portion, wherein:

(a) each of the central portion, the left sidewall and the right sidewall defines a portion of the elongate channel;

(b) the central portion, the left sidewall and the right sidewall are integrally formed one with another;

(c) the left sidewall and the right sidewall are not moveable with respect to each other, such that the gun is manually removable from the channel without adjustment of the position of the left sidewall and the right sidewall; and (d) the elongate channel is further configured to removably support the gun without requiring simultaneous manual support of the gun;

an attachment mechanism capable of securing the body to a support structure; and an opening formed in the central portion of the body at a position such that at least a portion of the trigger of the gun extends through the opening and beyond the body when the elongate channel receives the gun.

2. An apparatus as defined in claim 1, wherein each of the left sidewall and the right sidewall is laterally disposed with respect to the gun when the elongate channel receives the gun.

3. An apparatus as defined in claim 1, wherein the opening is a hole passing through the central portion.

4. An apparatus as defined in claim 1, wherein the opening is a slot extending into the central portion from a proximal end of the body, wherein the proximal end is nearest a stock of the gun when the elongate channel receives the gun.

5. An apparatus as defined in claim 1, wherein the body comprises a pliable portion positioned to be in contact with the gun when the elongate channel receives the gun.

6. An apparatus as defined in claim 5, wherein the body further comprises a substantially rigid substrate supporting the pliable portion.

7. An apparatus as defined in claim 1, wherein the attachment mechanism comprises means for attaching the apparatus to a tripod.

8. An apparatus as defined in claim 1, wherein the attachment mechanism comprises two or more threaded sockets disposed along a midline of the body, wherein any one of the two or more threaded sockets can be selected to be attached to a tripod.

9. An apparatus as defined in claim 1, further comprising a strap capable of being tightened over the gun and extending between the left sidewall to the right sidewall when the elongate channel receives the gun.

10. An assembly for supporting a gun, comprising:

a body having an elongate channel capable of removably receiving at least a portion of a region of a gun that extends between a trigger and a forearm of the gun, the body including a central portion, a left sidewall laterally disposed from the central portion, and a right sidewall laterally disposed from the central portion, wherein:

(a) each of the central portion, the left sidewall and the right sidewall defines a portion of the elongate channel;

(b) the central portion, the left sidewall and the right sidewall are integrally formed one with another;

(c) the left sidewall and the right sidewall are not moveable with respect to each other, such that the gun is manually removable from the channel without adjustment of the position of the left sidewall and the right sidewall; and (d) the elongate channel is further configured to removably support the gun without requiring simultaneous manual support of the gun;

an opening formed in the central portion of the body at a position such that at least a portion of the trigger of the gun extends through the opening and beyond the body when the elongate channel receives the gun; and a support structure that is removably attached to an attachment mechanism of the body and capable of resting on the ground.

11. An assembly as defined in claim 10, wherein the support structure is a tripod.

12. An assembly as defined in claim 11, wherein the body is rotatable with respect to legs of the tripod about a generally vertical axis.

13. An assembly as defined in claim 12, wherein the body is further rotatable with respect to the legs of the tripod about another axis that is not parallel to the generally vertical axis.

14. An assembly as defined in claim 10, further comprising the gun, wherein the gun is removably received by the elongate channel.

15. An assembly as defined in claim 14, wherein the gun is a sport shotgun or a sport rifle.

16. An assembly as defined in claim 10, wherein the body comprises means for attaching optical equipment to the body.

17. A method for supporting a gun, comprising the steps of:

providing a support assembly including:

a body having an elongate channel capable of removably receiving at least a portion of a region of a gun that extends between a trigger and a forearm of the gun, the body including a central portion, a left sidewall laterally disposed from the central portion, and a right sidewall laterally disposed from the central portion, wherein:

(a) each of the central portion, the left sidewall and the right sidewall defines a portion of the elongate channel;

(b) the central portion, the left sidewall and the right sidewall are integrally formed one with another;

(c) the left sidewall and the right sidewall are not moveable with respect to each other, such that the gun is manually removable from the channel without adjustment of the position of the left sidewall and the right sidewall; and (d) the elongate channel is further configured to removably support the gun without requiring simultaneous manual support of the gun;

an opening formed in the central portion of the body at a position such that at least a portion of the trigger of the gun extends through the opening and beyond the body when the elongate channel receives the gun; and a support structure removably attached to an attachment mechanism of the body;

placing the support structure on a fixed surface; and disposing the gun within the elongate channel such that the gun is removably secured to the body.

18. A method as defined in claim 17, wherein the step of disposing the gun within the elongate channel comprises the step of placing the gun such that at least a portion of a region of the gun that extends between a trigger and a forearm of the gun is in contact with the central portion, the left sidewall, and the right sidewall, wherein the left sidewall and the right sidewall constrain lateral motion of the gun with respect to the body.

19. A method as defined in claim 18, wherein the step of disposing the gun within the elongate channel further comprises the step of tightening a strap over the gun such that the strap extends between the left sidewall and the right sidewall.

20. A method as defined in claim 18, the step of disposing the gun within the elongate channel further comprising the step of passing a trigger of the gun into the opening such that at least a portion of the trigger passes through the opening and beyond the body.

21. A method as defined in claim 17, further comprising the step of rotating the body with respect to the support structure about a generally vertical axis.

22. A method as defined in claim 17, wherein the support structure is a tripod, the step of placing the support structure on a fixed surface comprising the step of placing the tripod on the ground.

23. A method as defined in claim 17, wherein the support structure is a tripod, the step of placing the support structure on a fixed surface comprising the step of placing the tripod on a bed of a body of water.

24. A method as defined in claim 18, further comprising the step of calibrating a scope of the gun while the gun is disposed within the elongate channel.

* * * * *